US006497771B1

(12) United States Patent
Schubach et al.

(10) Patent No.: US 6,497,771 B1
(45) Date of Patent: Dec. 24, 2002

(54) AQUEOUS SOLUTION AND METHOD FOR PHOSPHATIZING METALLIC SURFACES

(75) Inventors: Peter Schubach, Nidderau (DE); Joachim Heitbaum, Bad Homburg (DE); Thomas Kolberg, Heppenheim (DE); Margit Fleischhacker-Jeworrek, Usingen (DE); Peter Jorns, Frankfurt am Main (DE); Michael Deemer, Frankfurt am Main (DE); Ralf Stickler, Kahl am Main (DE); Jurgen Specht, Rodgau (DE); Michael Lenhard, Bad Vilbel (DE)

(73) Assignee: Metallgesellschaft Aktiengesellschaft, Frankfurt am Main (DE)

( * ) Notice: Subject to any disclaimer, the term of this patent is extended or adjusted under 35 U.S.C. 154(b) by 0 days.

(21) Appl. No.: 09/622,975

(22) PCT Filed: Feb. 27, 1999

(86) PCT No.: PCT/EP99/01186

§ 371 (c)(1),
(2), (4) Date: Jan. 9, 2001

(87) PCT Pub. No.: WO99/43868

PCT Pub. Date: Sep. 2, 2000

(30) Foreign Application Priority Data

Feb. 27, 1998 (DE) ..... 198 08 440

(51) Int. Cl.[7] ..... C23C 22/07

(52) U.S. Cl. ..... 148/253

(58) Field of Search ..... 148/253

(56) References Cited

U.S. PATENT DOCUMENTS

| | | | | | |
|---|---|---|---|---|---|
| 2,768,104 | A | * | 10/1956 | Schuster et al. | 148/258 |
| 5,137,589 | A | * | 8/1992 | Kinkelaar | 148/259 |
| 5,143,562 | A | * | 9/1992 | Boulos | 148/247 |
| 5,919,318 | A | * | 7/1999 | Brands et al. | 148/247 |
| 6,261,384 | B1 | * | 7/2001 | Kolberg et al. | 148/260 |

FOREIGN PATENT DOCUMENTS

| | | |
|---|---|---|
| DE | 977633 | 11/1967 |
| DE | 3800835 | 7/1989 |
| DE | 19634685 | 3/1998 |
| EP | 6333950 | 5/1996 |
| GB | 510684 | 8/1939 |
| GB | 2169620 | 7/1986 |
| WO | 9507370 | 3/1995 |

* cited by examiner

*Primary Examiner*—Roy King
*Assistant Examiner*—Tima McGuthry-Banks
(74) *Attorney, Agent, or Firm*—Antonelli, Terry, Stout & Kraus, LLP

(57) ABSTRACT

An aqueous solution contains phosphate for producing layers of phosphate on metal surfaces selected from the group consisting of iron, steel, zinc, zinc alloys, aluminum and aluminum alloys. The solution contains 0.3 to 5 g $Zn^{2+}$/1, 0.1 to 2 g nitroguanidine/1 and 0.05 to 0.5 g hydroxylamine/l, with an S-value amounting to 0.03 to 0.3 and the ratio of the weight of $Zn^{2+}$ to $P_2O_5$=1:5 to 1.30.

20 Claims, No Drawings

AQUEOUS SOLUTION AND METHOD FOR PHOSPHATIZING METALLIC SURFACES

The invention relates to an aqueous solution containing phosphate for producing phosphate layers on metal surfaces of iron, steel, zinc, zinc alloys, aluminium or aluminium alloys. The invention relates, furthermore, to a method for phosphatizing metal surfaces with the use of an aqueous phosphatization solution.

German Patent Application 196 34685.1 of the 28th August 1996 proposes an aqueous phosphate-containing solution for producing phosphate layers on metal surfaces of iron, steel, zinc, zinc alloys, aluminium or aluminium alloys, which solution contains 0.3 to 5 g $Zn^{2+}$/l and 0. 1 to 0. 3 g nitroguanidine/l, with the S-value amounting to 0.03 to 0.3 and the ratio of the weight of $Zn^{2+}$ to $P_2O_5$=1:5 to 1:30, and which solution produces crystalline phosphate layers in which the crystallites have a maximum edge length <15 $\mu$m. Furthermore, a method for phosphatization, in which the metal surfaces are cleaned, are subsequently treated with the afore-mentioned aqueous phosphate-containing solution for a period of 5 seconds to 10 minutes at a temperature of 15 to 70° C. and are finally rinsed with water, is proposed in said German patent application.

The underlying object of the invention is to improve the aqueous phosphate-containing solution and the method for phosphatization that have been proposed in German Patent Application 196 34 685.1 in such a way that the maximum edge length of the crystallites present in the phosphate layers that are produced is significantly <15 $\mu$m, that the phosphate layers that are produced have a layer weight of 2 to 4 g/l, and that the phosphate layers that are produced are constant or uniform with regard to the layer weight and the edge length of the crystallites even when the phosphatizing bath is operated for a comparatively long time.

The underlying object of the invention is achieved by providing an aqueous phosphate-containing solution for producing phosphate layers on metal surfaces of iron, steel, zinc, zinc alloys, aluminium or aluminium alloys, which solution contains 0.3 to 5 g $Zn^{2+}$/, 0.1 to 2 g nitroguanidine/l and 0.05 to 0.5 g hydroxylamine/l, with the S-value amounting to 0.03 to 0.3 and the ratio of the weight of $Zn^{2+}$ to $P_2O_5$=1:5 to 1.30. The nub of the invention thus lies in the fact that the solution, proposed in the aforementioned German patent application contains, in addition to the accelerator nitroguanidine also the accelerator hydroxylamine in a small concentration, with the nitroguanidine concentration of the solution in accordance with the invention having been significantly reduced in relation to the nitroguanidine concentration of the solution proposed in said German patent application.

According to the invention a solution that is particularly advantageous and preferred is one which contains 0.1 to 1.5 g nitroguanidine/l and also 0.1 to 0.4 g hydroxylamine/l. When these preferred features in accordance with the invention are applied, optimum phosphatization results are obtained.

Although, on the one hand, a solution for phosphatizing iron surfaces which has a zinc concentration of 0.2 to 2 g/l and contains as the accelerator hydroxylamine, hydroxylamine salts or hydroxylamine complexes that give the solution a hydroxylamine concentration of 0.5 to 50 g/l, preferably 1 to 10 g/l, is known from the printed specification EP-B 0 315 059 and although, on the other hand, a solution for producing copper-containing phosphate layers on metal surfaces of steel, zinc-coated steel, steel coated with zinc alloy, aluminium and its alloys, which solution has a zinc concentration of 0.2 to 2 g/l, a copper concentration of 0.5 to 25 mg/l, a $P_2O_5$ concentration of 5 to 30 g/l, contains as the accelerator hydroxylamine, hydroxylamine salts and hydroxylamine complexes that give the solution a hydroxylamine concentration of 0.5 to 5 g/l, and can additionally contain an organic nitro-compound as an oxidizing agent is known from the printed specification EP-B 0 633 950, it was extremely surprising for the person skilled in the art that already with comparatively small concentrations of nitroguanidine and hydroxylamine it was possible to produce phosphate layers that have an optimum layer weight of 2 to 4 g/$m^2$ and whose layer weight is very uniform even during continuous operation and whose crystallites in each case have a maximum edge length <15 $\mu$m, with, nevertheless, the edge length as a rule being significantly <10 $\mu$m. These surprisingly advantageous effects of the solution in accordance with the invention are linked with a further advantageous effect that lies in the fact that, on account of the comparatively small concentration of the accelerators, relatively small quantities of accelerator from the solution in accordance with the invention are entrained out of the phosphatization bath into the subsequent treatment stages and ultimately into the waste water. The solution in accordance with the invention thus guarantees that the two phosphatization accelerators are supplied in an almost quantitative manner.

The solution in accordance with the invention is also neither disclosed nor made obvious to the person skilled in the art by the prior art mentioned above, since, in comparison with the solution proposed in German patent application 196 34 685.1 the solution in accordance with the invention only uses the comparatively low nitroguanidine concentrations as well as additionally hydroxylamine and, in comparison with the solutions which are known from the two European patent specifications that have been mentioned, the solution in accordance with the invention uses hydroxylamine concentrations which are lower than the hydroxylamine concentrations disclosed in the prior art that has been mentioned added to this is the fact that in the two European patent specifications that have been mentioned the use of nitroguanidine as an accelerator is not disclosed and the two European patent specifications mentioned call upon the person skilled in the art to use high hydroxylamine concentrations, since in accordance with printed specification EP-B 0 315 059 a hydroxylamine concentration of 1 to 10 g/l is claimed as being preferred and in accordance with example 1 of the printed specification EP-B 0 633 950 operations are carried out with a hydroxylamine concentration of 1.7 g/l the merit of the present invention therefore lies in having recognized that it is possible to deposit on various metal surfaces qualitatively very high-grade phosphate layers from a solution which has a very low hydroxylamine content and a comparatively small nitroguanidine content, in which case, with regard to the hydroxylamine content the invention does not follow the course marked out by the prior art, namely the use of quite high hydroxylamine concentrations.

In a further development of the invention it is provided that the solution contain 0.3 to 3 g $Zn^{2+}$/l. The solution is therefore preferably suitable for use within the scope of low-zinc technology. Furthermore, in a further development of the invention it is provided that the solution additionally contain 0.5 to 20 g $NO_3^-$/l, that the solution additionally contain 0.01 to 3 g $Mn^{2-}$/l and/or 0.01 to 3 g $N^{2+}$/l and/or 1 to 100 mg $Cu^{2+}$/l and/or 0.01 to 3 g $Co^{2+}$/l. In particular, the copper content of 1 to 100 Mg $Cu^{2+}$/l in the absence of nickel is responsible for the fact that qualitatively high-grade phosphate layers are produced. During the phosphatization of surfaces containing aluminium it has proved to be particularly useful in accordance with the invention if the solution contains 0.01 to 3 g $F^-$/l and/or 0.05 to 3.5 g/l of at least one complex fluoride. In accordance with the invention the solution contains $(SiF_6)^{2-}$ or $(BF_4)^-$ as the complex fluoride.

The nitrate content in accordance with the invention advantageously promotes the observance of a constant layer weight. The nitrate is added to the phosphatization solution in the form of alkali nitrates and/or by means of the cations present in the system, for example as zinc nitrate and/or as $HNO_3$. Since the nitrate-free aqueous solution also delivers good phosphatization results, the acceleration effect of the nitrate, which is known per se, is very probably of secondary importance in the present case. The metal ions $Mn^{2+}$, $Ni^{2+}$, $Cu^{2+}$ and $Co^{2+}$ that are added to the phosphatization solution are incorporated in the phosphate layer and improve the lacquer adhesion and the corrosion protection. The free fluoride is added to the phosphatization solution when metal surfaces made of aluminium or aluminium alloys are phosphatized. The complex fluorides are added to the phosphatization solution in particular to improve the result of phosphatization on surfaces that are coated with zinc.

The underlying object of the invention is achieved, furthermore, by the provision of a method for phosphatizing metal surfaces, wherein the metal surfaces are cleaned, are subsequently treated with the aqueous phosphate-containing phosphatization solution for a period of 5 seconds to 10 minutes at a temperature of 15 to 70° C. and are finally rinsed with water. This method can be carried out with simple technical means and works operationally in an extremely reliable manner. The phosphate layers produced by is means of the method are of a consistently good quality which does not diminish even when the phosphatization bath is operated for a comparatively long time. The minimum phosphatizing time in the case of the method in accordance with the invention is less than in the case of the known low-zinc methods which operate with the usual accelerators. What is considered to be the minimum phosphatizing time is the time during which the surface is phosphatized so as to become closed. Surprisingly, it has been found that the method parameters that have proved to be advantageous in the case of the method proposed in German Patent Application 196 34 685.1 can generally also be used in the case of the method in accordance with the invention.

It is proposed in accordance with the invention that the treatment of the metal surfaces with the phosphatization solution be effected by spraying, dipping, spray-dipping or roller-application. These operating techniques open up a very broad and varied application spectrum for the method in accordance with the invention. In accordance with the intention it has proved to be particularly advantageous if the phosphatization solution used for spraying has a ratio of the weight of $Zn^{2-}$ to $P_2O_5$=1:5 to 1:30, with the period required for spraying amounting to 5 to 300 seconds, and if the phosphatization solution used for dipping has a ratio of the weight of $Zn^{2+}$ to $P_2O_5$=1:5 to 1:18, with the period required for dipping amounting to 5 seconds to 10 minutes.

In accordance with the invention it is advantageous in many cases if, after having been cleaned, the metal surfaces are treated with an activating agent which contains a titanium-containing phosphate. This assists the formation of a closed, crystalline phosphate layer. Moreover, in accordance with the invention it is provided that the metal surfaces be treated with a passivating agent subsequent to the rinsing process that follows phosphatization. The passivating agents used can both contain Cr and also be free from Cr.

When cleaning the metal surfaces as provided according to the method in accordance with the invention, both mechanical impurities and adherent grease are removed from the surface that is to be phosphatized. Cleaning the metal surfaces belongs to the known prior art and can advantageously be carried out with an aqueous alkaline cleaner. It is advantageous if the metal surfaces are rinsed with water after cleaning. The cleaned or phosphatized metal surfaces are rinsed either with tap water or with desalinated water.

In accordance with the invention it is particularly advantageous if the nitroguanidine is introduced into the aqueous solution in the form of a stable, aqueous suspension. This can either be effected the stable, aqueous suspension containing a layer silicate as a stabilizer, with the layer silicates $[Mg_6(Si_{7.4}Al_{0.6})O_{20}(OH)_4]Na_{0.6}\times XH_2O$ or $[(Mg_{5.4}Li_{0.6})Si_8O_{20}(OH,F)_4]Na_{0.6}\times XH_2O$ being used in a quantity of 10 to 30 g/l nitroguanidine suspension, or can be effected by the stable, aqueous suspension contains a stabilizer which consists of a polymeric sugar and polyethylene glycol, with the ratio of the weight of the polymeric sugar to polyethylene glycol amounting to 1:1 to 1:3 and with the stabilizer being used in a quantity of 5 to 20 g/l nitroguanidine suspension. As a result of the two stabilizers of the nitroguanidine suspension, advantageously the suspension remains unchanged for several months and desludging in the phosphatization bath is promoted The introduction of the nitroguanidine into the phosphatization solution in the form of a stabilized suspension avoids the disadvantages which arise from the fact that nitroguanidine is present as a powder and in this form can only be evenly distributed in the phosphatization solution with difficulty. The suspensions produced in accordance with the invention can easily be conveyed by pumping and are stable for 12 months, that is, the nitroguanidine does not settle even after a comparatively long period of time. The suspensions are produced by suspending the laminated silicate or the organic stabilizer in completely desalinated water and mixing the nitroguanidine in afterwards.

The suspension is destroyed at the pH-value of 2 to 4 that prevails in the phosphatization solution and the nitroguanidine is released in a finely dispersed form and dissolved.

Finally, it is provided in accordance with the invention that the solution according to the invention and also the method according to the invention be used to treat work pieces before lacquering, in particular before electro-dip lacquering The subject of the invention is explained in greater detail in the following, as well as with reference to exemplifying embodiments.

A) Definitions

The $Zn^{2+}$:$P_2O_5$ ratio relates to the total $P_2O_5$. The determination of the total $P_2O_5$ is based on the titration of the phosphoric acid and/or the primary phosphates from the equivalence point of the primary phosphate to the equivalence point of the secondary phosphate. The S-value indicates the ratio of free acid, calculated as free $P_2O_5$, to the total $P_2O_5$ The definitions and methods of determination for the total $P_2O_5$ and the free $P_2O_5$ are explained in detail in the publication by W. Rausch "Die Phosphatierung von Metallen", 1988, pages 289 to 304.

B) Method Parameters

The following comparative examples and exemplifying embodiments were carried out by applying the following method steps;

a) The surfaces of metal objects consisting of steel plate were cleaned, and in particular degreased, with a slightly alkaline cleaner (2%, aqueous solution) for 6 minutes at 60° C.

b) Rinsing with tap water for 0.5 minutes at room temperature followed.

c) Subsequently, activation with a fluid activating agent, which contained a titanium phosphate, was effected for 0.5 minutes at 50° C.

d) Afterwards, phosphatization was carried out by dipping at approximately 55° C. for 3 minutes.

e) Finally, rinsing was carried out with tap water for 0.5 minutes at room temperature.

f) The phosphatized surfaces were dried in a furnace at 80° C. for 10 minutes.

C) Concentrates for the Preparation of the Phosphatization Solution

Concentrate I contains, with the exception of hydroxylamine and $Cu^{2+}$, all the inorganic constituents of the phosphatization solution. Concentrate II consists of a stabilized nitroguanidine suspension. Concentrate III consists of an aqueous solution of hydroxylamine salts, hydroxylamine complexes or hydroxylamine. If a phosphatization solution containing $Cu^{2+}$ is required, a concentrated $Cu^{2+}$-solution is used as concentrate IV. It metal surfaces of aluminium or aluminium alloys are to be phosphatized, a solution that contains compounds which form free fluoride is used as concentrate V. The phosphatization solution in accordance with the invention is produced by mixing the respective concentrates I to V that are required whilst simultaneously adding water. If the phosphatizing bath is shut down for a comparatively long period of time, partial decomposition of the hydroxylamine often results. The hydroxylamine losses resulting therefrom are compensated for by adding concentrate III to the phosphatizing bath. Aqueous solutions of hydroxylamine salts, hydroxylamine complexes or hydroxylamine are used in a known manner as the hydroxylamine source.

D) Exemplifying Embodiments and Comparative Examples

Two steel plates zinc-coated on one side and of differing quality (Z1 and Z2) were phosphatized ln accordance with the method parameters specified under B). The phosphatizing bath had the respective composition specified in the Table, with the total $P_2O_5$-content in all the examples amounting to 12 g $P_2O_5$/l and with the symbols used in the Table having the following meaning:

FS=free acid

TS=total acid

Zn=$Zn^{2+}$, g/l

NG nitroguanidine, g/l

HA=hydroxylamine, g/l

Cu=$Cu^{2+}$, mg/l

Mn=$Mn^{2+}$, g/l

The phosphatization in accordance with Comparative Example 1 was carried out with the exclusion of accelerators. In Comparative Example 2 merely the accelerator hydroxylamine was present, whilst in Comparative Example 3 operations were carried out merely with the accelerator nitroguanidine. The exemplifying embodiments 4 to 9 were carried out in the presence of both accelerators, with the concentration of both accelerators lying in the preferred range in accordance with the invention.

Both the layer weights and the crystallite edge lengths that could be attained when carrying out Examples 1 to 9 are specified in the Table. This data shows that in the case of Comparative Example 1, which was carried out in the absence of the two accelerators in accordance with the invention, a phosphate layer of insufficient quality resulted, because both the layer weight and the edge length of the crystallites of the phosphate layer are comparatively large. In the case of Comparative Examples 2 and 3, layer weights that are still tolerable as well as sufficiently small crystallite edge lengths were obtained so both phosphate layers can be regarded as being positively useful. Exemplifying embodiments 4 to 9 show that in accordance with the invention, it was possible to produce not only optimum layer weights, but also extremely fine-crystalline phosphate layers. Exemplifying embodiments 4 to 9 thus prove that phosphate layers of very high quality can be produced by means of the invention, that is, with the use of very small concentrations of nitroguanidine and hydroxylamine in the phosphatizing bath. Of course, the phosphate layers produced in accordance with Examples 1 to 9 were closed. The edge lengths of the crystallites specified in the Table were ascertained with the aid of electron-microscopic images of the individual phosphate layers.

| Example | Phosphatizing Bath | | | | | | | Layer weight g/m² | | Crystallite edge length μm | |
|---|---|---|---|---|---|---|---|---|---|---|---|
| No. | TS | GS | Zn g/l | NG g/l | HA g/l | Cu mg/l | Mn g/l | Z1 | Z2 | Z1 | Z2 |
| 1 | 2.3 | 25.7 | 1.6 | 0 | 0 | 6 | 1.0 | 8.0 | 5.5 | 10–15 | >15 |
| 2 | 2.4 | 25.7 | 1.6 | 0 | 0.20 | 6 | 1.0 | 4.0 | 5.5 | <10 | <10 |
| 3 | 2.4 | 24.6 | 1.6 | 0.40 | 0 | 5 | 1.0 | 6.0 | 6.5 | <10 | <10 |
| 4 | 2.3 | 24.0 | 1.5 | 0.40 | 0.22 | 5 | 1.0 | 4.0 | 4.0 | <5 | <5 |
| 5 | 2.3 | 23.5 | 1.5 | 0.55 | 0.23 | 4 | 0.9 | 2.3 | 2.3 | <5 | <5 |
| 6 | 2.3 | 23.1 | 1.4 | 0.75 | 0.23 | 3 | 0.9 | 2.8 | 2.5 | <3 | <3 |
| 7 | 2.3 | 21.0 | 1.2 | 0.67 | 0.15 | 3 | 0.9 | 2.0 | 2.0 | <3 | <3 |
| 8 | 2.2 | 22.0 | 1.3 | 0.68 | 0.18 | 3 | 0.9 | 2.0 | 2.3 | <3 | <3 |
| 9 | 2.2 | 22.4 | 1.2 | 0.63 | 0.19 | 2 | 0.9 | 2.2 | 2.4 | <5 | <3 |

What is claimed is:

1. Aqueous solution containing phosphate for producing layers of phosphate on metal surfaces selected from the group consisting of iron, steel, zinc, zinc alloys, aluminum and aluminum alloys, which solution contains 0.3 to 5 g $Zn^{2+}$/1, 0.1 to 2 g nitroguanidine/l and 0.05 to 0.5 g hydroxylamine/l, with an S-value amounting to 0.03 to 0.3 and the ratio of the weight of $Zn^{2+}$ to $P_2O_5$=1:5 to 1.30.

2. Aqueous solution according to claim 1, which solution contains 0.1 to 1.5 g nitroguanidine/l.

3. Aqueous solution according to claim 1, which solution contains 0.1 to 0.4 g hydroxylamine/l.

4. Aqueous solution according to claim 1, which solution contains 0.3 to 3 g $Zn^{2+}$/l.

5. Aqueous solution according to claim 1, which solution contains 0.5 to 20 g $NO_3^-$/l.

6. Aqueous solution according to claim 1, wherein solution contains at least one member selected from the group consisting of 0.01 to 3 g $Mn^{2+}$/1, 0.01 to 3 g $Ni^{2+}$/1, 1 to 100 mg $Cu^{2+}$/1 and 0.01 to 3 g $Co^{2+}$/1.

7. Aqueous solution according to claim 1, which solution contains at least one member selected from the group consisting of 0.01 to 3 g $F^-$/1 and 0.05 to 2.5 g/l of at least one complex fluoride.

8. Aqueous solution according to claim 1, which solution also contains $(SiF_6)^{2-}$ or $(BF_4)^-$ as a complex fluoride.

9. Method for phosphatizing metal surfaces, comprising:

cleaning the metal surfaces;

subsequently treating the metal surfaces with the aqueous, phosphate-containing solution according to claim 1 for a period of 5 seconds to 10 minutes at a temperature of 15 to 70° C.; and finally rinsing the metal surfaces.

10. Method according to claim 9, wherein the treatment of the metal surfaces with the phosphate-containing solution is effected by spraying, dipping, spray-dipping or roller-application.

11. Method according to claim 1, wherein the phosphate-containing solution used for spraying has a ratio of the weight of $Zn^{2+}$ to $P_2O_5$=1:5 up to 1:30 and the period required for spraying amounts to 5 to 200 seconds.

12. Method according to claim 1, wherein the phosphate-containing solution used for dipping has a ratio of the weight of $Zn^{2+}$ to $P_2O_5$=1:5 to 1:18 and the period required for dipping amounts to 5 seconds to 10 minutes.

13. Method according to claim 9, wherein, after having been cleaned, the metal surfaces are treated with an activating agent which contains titanium phosphate.

14. Method according to claim 9, wherein after the rinsing process that follows phosphatization, the metal surfaces are subsequently treated with a passivating agent.

15. Method according to claim 9, wherein the nitroguanidine is introduced into the aqueous solution in the form of a stable, aqueous suspension.

16. Method according to claim 15, wherein the stable, aqueous suspension contains a layer silicate as a stabilizer.

17. Method according to claim 16, wherein the layer silicates $[Mg_6(Si_{7.4}Al_{0.6})O_{20}(OH)_4]Na_{0.6}\times xH_2O$ or $[(Mg_{5.4}Li_{0.6})Si_8O_{20}(OH, F)_4]Na_{0.6}\times XH_2O$ are used as the stabilizer in a quantity of 10 to 30 g/l nitroguanidine suspension.

18. Method according to claim 15, wherein the stable, aqueous suspension contains a stabilizer which consists of a polymeric sugar and polyethylene glycol, with the ratio of the weight of the polymeric sugar to polyethylene glycol amounting to 1:1 to 1:3 and with the stabilizer being used in a quantity of 5 to 20 g/l nitroguanidine suspension.

19. Method according to claim 9, further comprising lacquering the metal surfaces.

20. Method according to claim 19, further comprising electro-dip lacquering the metal surfaces.

* * * * *